United States Patent [19]

Barlow et al.

[11] Patent Number: 4,468,031

[45] Date of Patent: Aug. 28, 1984

[54] THREE-DIMENSIONAL GAME WITH ROTATABLE TRACK PIECES FOR SELF-PROPELLED VEHICLE

[75] Inventors: Gordon A. Barlow; John R. Krutsch, both of Glenview, Ill.

[73] Assignee: Gordon Barlow Design, Skokie, Ill.

[21] Appl. No.: 419,960

[22] Filed: Sep. 20, 1982

[51] Int. Cl.[3] ..... A63F 9/14

[52] U.S. Cl. ..... 273/110; 273/86 B; 273/1 GB; 446/138; 446/445

[58] Field of Search ..... 273/1 GA, 1 GB, 86 B, 273/110; 104/130, 131, 58; 46/202, 251, 241, 43

[56] References Cited

U.S. PATENT DOCUMENTS

| | | | |
|---|---|---|---|
| 2,571,521 | 10/1951 | Barnhart | 273/120 R X |
| 2,655,116 | 10/1953 | Gowland | 104/58 |
| 3,074,200 | 1/1963 | Ziegenfuss | 46/202 X |
| 3,592,471 | 7/1971 | Swimmer | 273/120 R |
| 4,227,693 | 10/1980 | Moe et al. | 273/86 C |

FOREIGN PATENT DOCUMENTS

| | | | |
|---|---|---|---|
| 680570 | 2/1964 | Canada | 46/241 |
| 7099139 | 8/1955 | France | 46/202 |
| 298851 | 11/1928 | United Kingdom | 273/1 GA |

*Primary Examiner*—Richard C. Pinkham
*Assistant Examiner*—Scott L. Brown
*Attorney, Agent, or Firm*—Kinzer, Plyer, Dorn & McEachran

[57] ABSTRACT

A three-dimensional game having rotatable track members mounted on a support frame on which a self-propelled vehicle may be guided over a predetermined course through rotation of the track members. The track members are mounted on the support frame so that they can be rotated into a plurality of positions in some of which positions a set of track members forms a substantially continuous path upon which the vehicle may travel from one track member to another track member. Rotation of the track members is accomplished through manipulation of a set of attached knobs. Each track member may include a metal panel to which the magnetized wheels of the self-propelled vehicle are attracted, allowing for rotation of a vehicle-carrying track member in a full circle without the vehicle falling from the track member. The players guide the vehicle over a course depicted on a card drawn from a deck of cards, aligning the track members, while the vehicle is moving, so that the vehicle travels from one track member to another until the prescribed course is completed.

6 Claims, 10 Drawing Figures

Fig. 7.
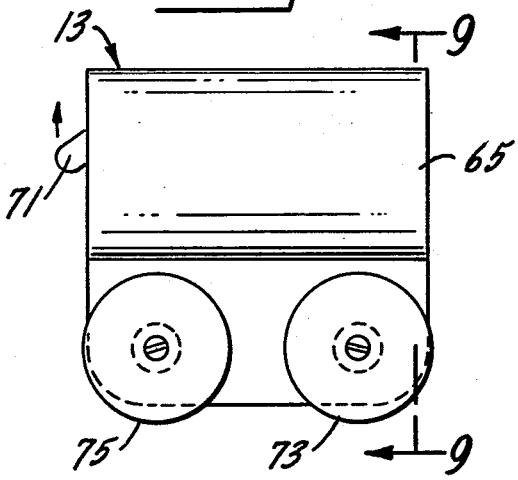
Fig. 8.
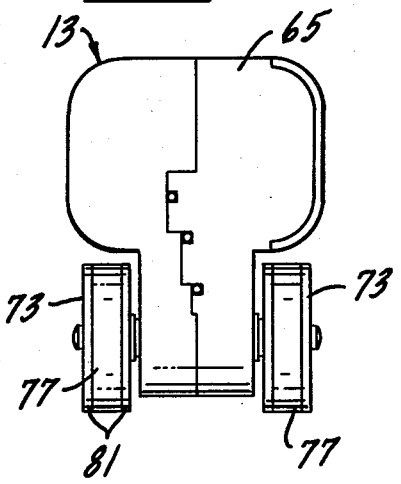
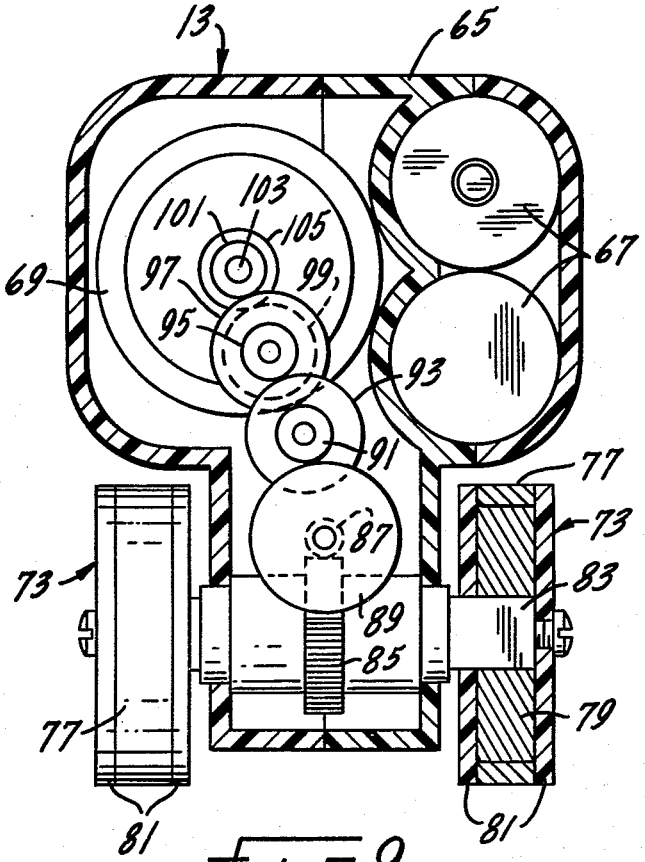
Fig. 9.
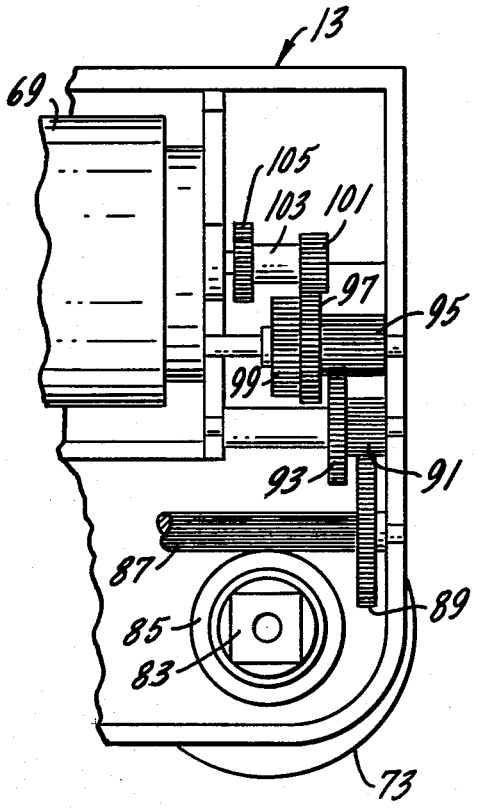
Fig. 10.

THREE-DIMENSIONAL GAME WITH ROTATABLE TRACK PIECES FOR SELF-PROPELLED VEHICLE

SUMMARY OF THE INVENTION

This invention is concerned with a three-dimensional game which can be played by two or more players and which utilizes a set of rotatable track members with the objective of guiding a self-propelled vehicle over a predetermined course by rotating the track members so as to form a continuous path for the vehicle to traverse.

Each track member is capable of being rotated into a position roughly contiguous with some other track members, providing a wide range of possible courses of varying degrees of difficulty over which the vehicle may be guided. In the preferred embodiment, the track members include metal panels and the wheels of the vehicle are magnetic; thus, a given track member may be rotated in a full circle while being traversed by the vehicle without the vehicle falling off the track member. This further increases the variety of possible courses and manipulations. Other means for holding the vehicle on the track members may also be employed.

The manipulation of the track members is accomplished while the vehicle is moving across the track members, thus requiring a degree of skill and dexterity to rotate the track members into proper alignment before the moving vehicle crosses the track. The self-propelled vehicle can be adapted to move at either a low or high speed depending on the ability of the players.

A set of cards, included as part of this game, depicts a variety of courses over which the players must attempt to guide the vehicle. Each course is assigned a point value according to the degree of difficulty involved in traversing the course. A player wins the game by accumulating the highest score.

Other purposes and uses of this invention will be found in the following specification and drawings.

BRIEF DESCRIPTION OF THE DRAWINGS

The invention is illustrated more or less diagrammatically in the following drawings wherein:

FIG. 7 is a side elevational view of the self-propelled vehicle of this invention;

FIG. 8 is a front plan view of the self-propelled vehicle of this invention;

FIG. 9 is an enlarged cross-sectional view of the self-propelled vehicle of FIG. 7, taken along line 9—9 of FIG. 7 with the motor support wall omitted for clarity;

FIG. 10 is an enlarged, partial, interior side view of a portion of the self-propelled vehicle

DESCRIPTION OF THE PREFERRED EMBODIMENT

Figure 1:
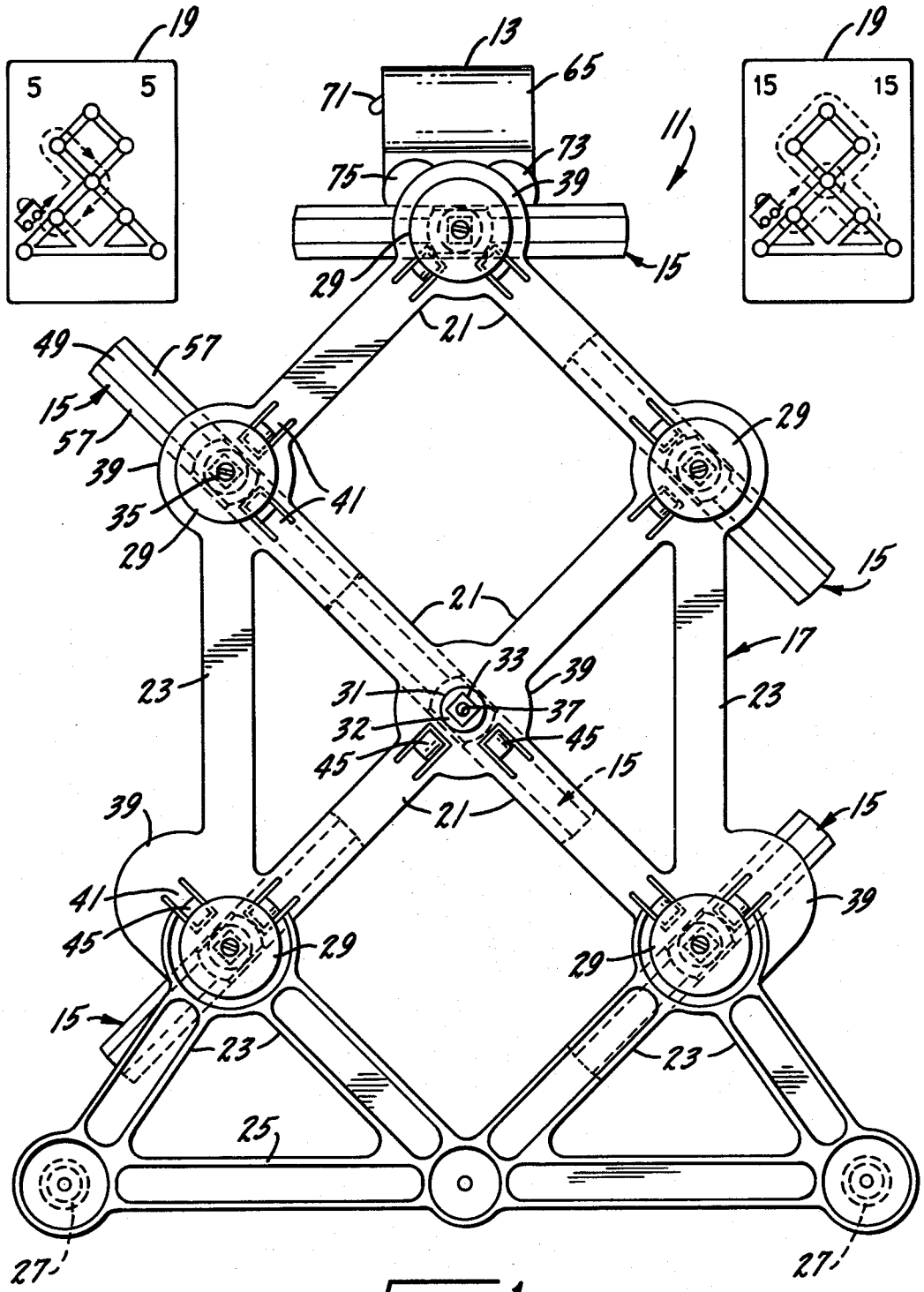
FIG. 1 is a front plan view of the three-dimensional game of this invention, with illustrative cards shown.

A three-dimensional game 11 embodying the novel aspects of this invention is shown in FIGS. 1 through 10 of the drawings. It includes a self-propelled vehicle 13 which travels on a set of rotatable track members 15 mounted on a two-piece support frame 17. A deck of playing cards is also included as part of the game, each playing card 19 depicting a course over which the self-propelled vehicle 13 is to be guided through rotation of the track members.

In the preferred embodiment of this invention, six track members 15, all substantially alike, are rotatably mounted on the two-piece frame 17. The two pieces of the frame are similarly-shaped. As shown in FIG. 1, each piece of the frame is comprised of a set of integrally-formed frame members of various lengths. Generally, the lengths of the diagonal frame members 21 connecting the track members 15 are substantially equal to the lengths of the track members. Thus, two track members 15 may be rotated into a position substantially parallel to the connecting diagonal frame member 21, in which position the track members are roughly contiguous, forming a substantially continuous path upon which the self-propelled vehicle may travel from one track member to another. There is sufficient clearance between the track members when mounted on the frame in this manner so as to allow each track member to be rotated in a full circle without interference from the frame or from another track member.

The remaining support frame members 23 and the base members 25 serve to supply structural strength and stability to the frame 17. The support frame members 23 and the base members 25 generally do not define possible paths of travel for the self-propelled vehicle. Connecting rods 27 join the two pieces of the frame near the ends of the base members 25. The frame is preferrably injection molded of a suitable plastic though it should be understood and appreciated that other conventional materials may be utilized in constructing the frame.

It should also be be understood and appreciated that the number of track members and the frame structure shown are not essential to this invention. It is only necessary that the frame be so constructed as to hold the track members in a spaced relationship such that the track members may be rotated in a full circle without interference from other track members or from the frame, and that the track members be held in close enough proximity as to allow for rotation of the track members into positions where some track members are substantially contiguous to each other and are in substantially the same plane.

FIG. 1 also illustrates a set of knobs 29 used to manipulate the track members. Each knob is connected to a spindle 31 of a track member. To illustrate the structure of the spindle, the central track member of FIG. 1 is shown with its knob removed. A first cylindrical portion 32 of the spindle extends through a complementary hole in the frame 17, to allow for rotation of the track member about the spindle. A second portion 33 of the spindle is square in cross-section and fits into a complementary recessed area in the knob 29. The knobs are secured to the spindles through screws 35 which fit into threaded holes 37 in the spindles 31. This arrangement allows for rotation of the track members in a full circle through manipulation of the knobs.

Each knob 29 may be identified by a different color. The playing cards 19, which schematically depict the structure of the support frame and knobs, are colorcoordinated with the knobs of the three-dimensional game.

Figure 2:
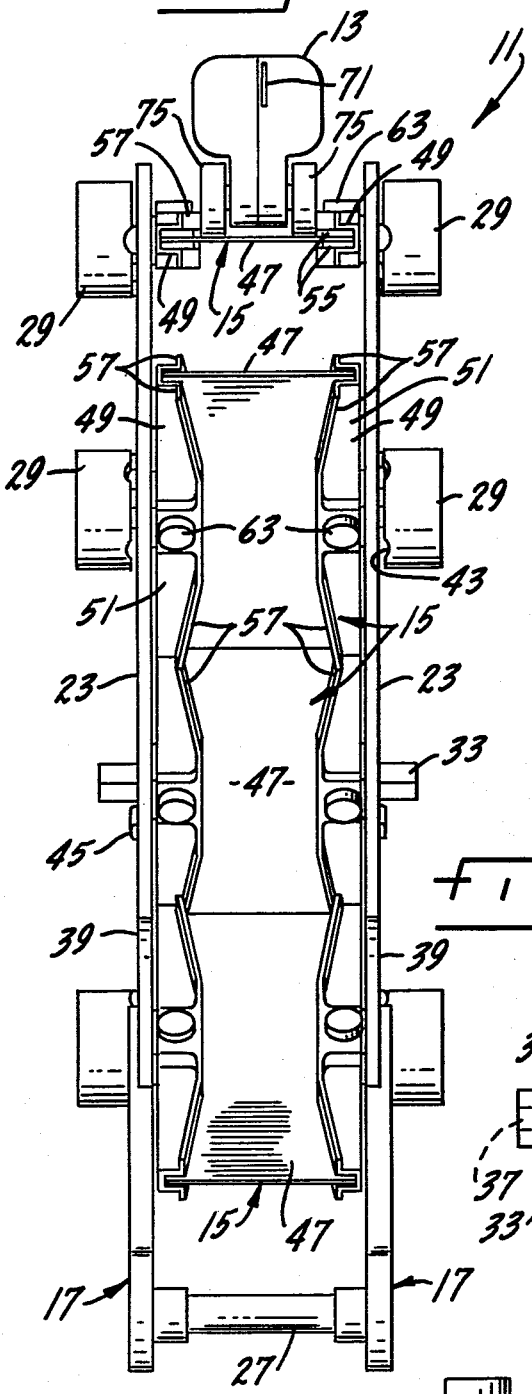
FIG. 2 is a side elevational view of the three-dimensional game of this invention.

FIG. 2 shows the two-piece frame 17 joined at the base members 25 by the connecting rods 27. Throughout the remainder of the frame, the two pieces of the frame are joined by the track members 15, together with the knobs 29 connected thereto.

The frame 17 has enlarged areas 39 in the vicinity of each knob and also has spring action tabs 41 for retaining each track member in a given position. Each knob 29 has notches 43 in the outer rim of its base for catching a detent 45 of a spring action tab 41. Together, these structures define a preferred means for retaining each track member in a given position.

Figure 3:
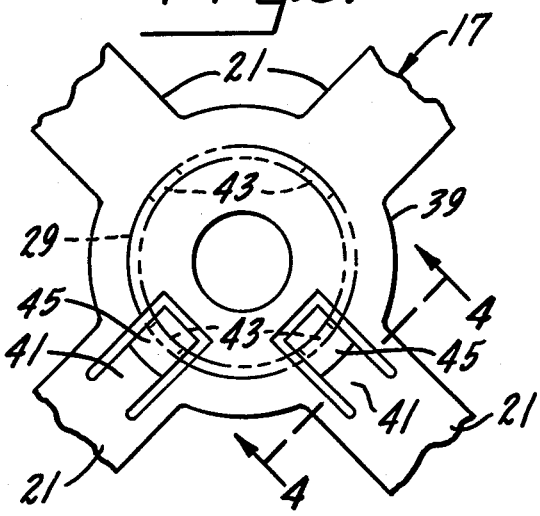
FIG. 3 is an enlarged partial front plan view of the frame center of the three-dimensional game with portions shown in phantom lines for clarity of illustration.
Figure 4:
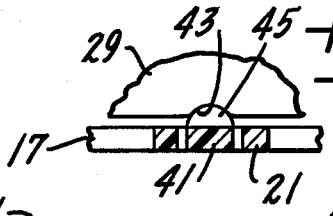
FIG. 4 is a partial cross-sectional view of the support frame and knob taken along line 4—4 of FIG. 3.

The preferred retaining means is further illustrated in FIGS. 3 and 4. When a knob 29 is turned, the associated spring action tabs 41 and the detents 45 of the tabs are pushed downward by the flat portion of the knob's base. When a notch 43 is positioned above a tab 41, that tab springs up and its detent locks into the notch, as shown in FIG. 4. Thus, the combination of the spring action tabs and the notches in the knobs serves to retain the knobs, and thereby retain the track members, in a given position, preventing rotation of the track members independent of the player's manipulation. This retaining means does not, however, hold the knobs so tightly as to hamper the player in turning the knobs during play, when quick action is necessary. It should be understood that other retaining means will suffice for the purposes of this invention.

It should be noted that each knob 29 in the preferred embodiment has four notches 43 spaced at approximately equal distances around the knob. Two spring action tabs are provided for each knob, the tabs being at about right angles to each other. Thus, the track members may be held or locked in a plurality of positions, with two notches of each knob being engaged by two spring action tabs. The orientation of the notches and the tabs is such that the track members are lockable into positions where they are in the same or parallel planes, or in perpendicular planes. Thus, a player may lock two track members into a position where they are aligned to form a continuous path, which the vehicle can traverse without the player having to manually hold the track members in this position, enabling the player to set up the next track members in the sequence with the necessary speed. Also, track members not part of the desired course may be held out of the way so as to not interfere with the vehicle's travel.

Figure 5:
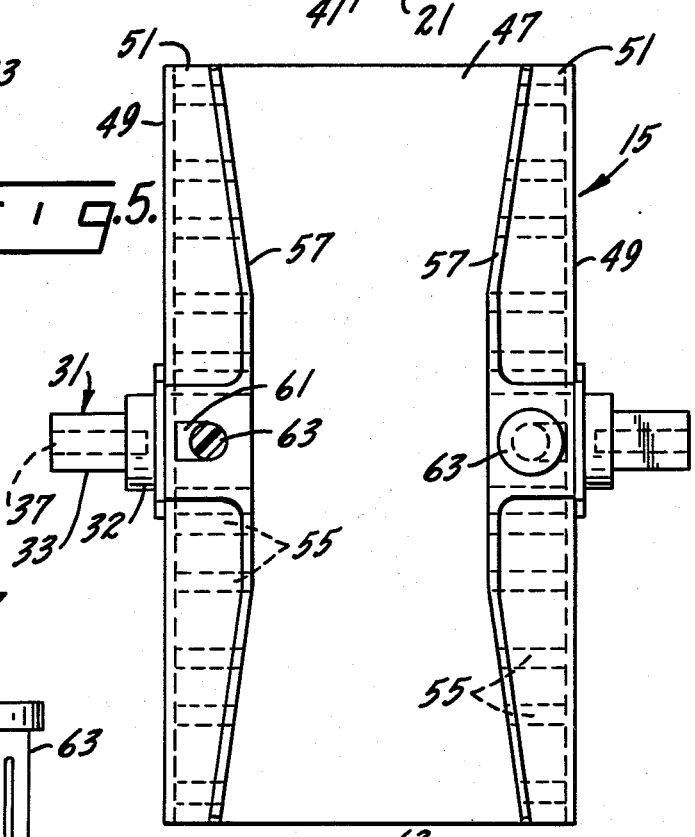
FIG. 5 is an enlarged plan view of a representative track member.
Figure 6:
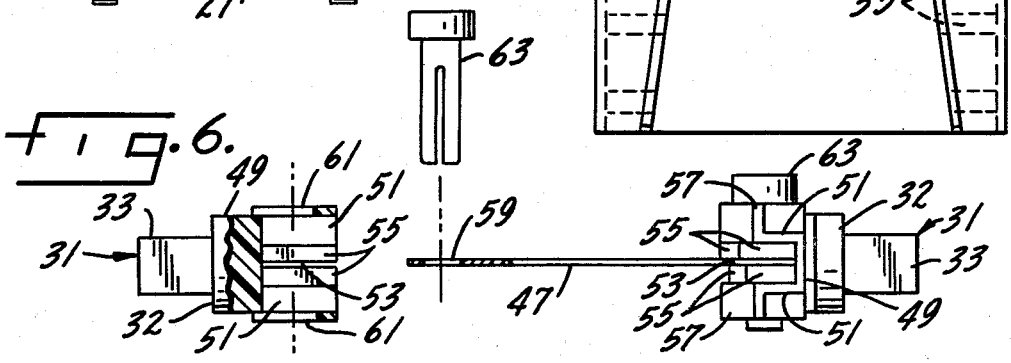
FIG. 6 is an enlarged side elevational view of a representative track member with one of the track member holders disassembled, and with some parts shown in partial cross-section for clarity of illustration.

FIG. 5 shows an illustrative example of a track member 15, all of which are alike. In the preferred embodiment, each track member comprises a thin, rectangular metal panel 47 and two holders 49.

As shown, each holder 49 is roughly U-shaped in cross section and extends the length of the metal panel, forming two shoulders 51 which define a channel 53 wherein the longitudinal edge of the metal panel 47 is held. Each shoulder 51 extends over a portion of the surface of the metal panel. The two shoulders have sets of opposing projections 55 integral with each shoulder. The metal panel is held rigidly between these sets of projections. In this embodiment, the projections on each shoulder are spaced along the length of the shoulder and the sets of opposing projections are staggered. The opposing projections abut directly against both surfaces of the metal panel, holding the panel rigid and flat.

The shape of the shoulders 51 is also functional in that the shoulders maintain the vehicle on a substantially straight path parallel to the longitudinal axis of each track member 15. Each shoulder 51 has raised edges 57. Together, the raised edges 57 of the two holders 49 define a path for the vehicle. The edges 57 of the two holders 49 converge towards the center of the panel 47, where the edges are substantially parallel to each other. The distance between the raised edges of the shoulders in the vicinity of the center of the panel is somewhat greater than the width of the wheel base of the vehicle. Thus, the vehicle's direction of travel will be maintained in a direction substantially parallel to the longitudinal axis of each track member throughout the course. It should also be noted that both sides of the track members are the same so that the vehicle may travel on either surface of the metal panel.

The spindles 31, through which the track members 15 are rotatably mounted on the support frame 17, are integral with the holders 49. The holders, including the spindles, may be injection molded of a suitable plastic though it should be understood and appreciated that other conventional materials may be utilized in constructing the holders.

Each metal panel 47 has two holes 59 near the centers of the longitudinal edges of the panels. Each holder 49 has complementary holes 61. In assembling the track members, the two holders are slid onto the metal panel. The holes of the holder are aligned with the holes of the metal panel, and a spring action pin 63 is pushed through the aligned holes, securing the holders to the metal panel.

The self-propelled vehicle 13 includes a two-piece housing 65 and contains one or more batteries 67 which power an electric motor 69. The batteries may each be 1½ volts of the conventional AA type. A switch 71 is provided on the outside of the housing 65 for energization of the electirc motor. The motor propels the vehicle through a pair of front drive wheels 73. In the preferred embodiment both the front drive wheels 73 and the rear wheels 75 include magnetizable rings 77 which are mounted on the surfaces of the wheels and which are magnetized by permanent magnets 79 held within the wheels, encircled by the rings 77. The magnetized rings 77 and the permanent magnets 79 comprise a preferred means for magnetizing a plurality of the wheels of the self-propelled vehicle. Other magnetizing means are also within the scope of this invention. In the preferred embodiment, each magnetized ring 77 is held between two rings 81 or disks used to aid in propelling the vehicle across the track members 15.

The rings 77 and permanent magents 79 of the wheels of the vehicle and the metal panels 47 of the track members 15 comprise a preferred means for holding the self-propelled vehicle on the track members. It is the magnetic attraction of the magnetized rings for the metal panels which holds the vehicle on the track members even when the vehicle is upside down when the track members are rotated in a full circle. To utilize this magentic attraction, it is not necessary that the track members include metal panels 47 as shown and described above; it is only necessary that a metallic pathway be provided on each track member. It should also be understood and appreciated that it is not necessary to utilize magentic attraction in the means for holding the vehicle on the track members. Other holding means may be used and are within the scope of this invention. It is only necessary that the holding means hold the vehicle on the track members when the track members are rotated in a full circle while not impeding the vehicle's traversal of the track members.

The front drive wheels 73 of the self-propelled vehicle 13 are mounted on an axle 83 which is affixed to a worm wheel 85 which engages a worm gear 87. Affixed to the worm gear 87 is a first gear wheel 89 which engages a first splined shaft 91. The first splined shaft 91 is affixed to a second gear wheel 98 which engages a second splined shaft 95. Affixed to the second splined shaft are two gear wheels, a third gear wheel 97 and a fourth gear wheel 99, the diameter of the third gear wheel 97 being somewhat greater than that of the fourth gear wheel 99. As shown in FIG. 10, the third gear wheel 97 engages a first spur gear 101 which is affixed to a drive shaft 103, the drive shaft being driven by the electric motor 69. A second spur gear 105 is also affixed to the drive shaft 103. Means may be provided for shifting from the engagement of the first spur gear 101 with the third gear wheel 97 to the engagement of the second spur gear 105 with the fourth gear wheel 99, in which case the vehicle will be operable at two speeds, thereby adding a further variant to the difficulty of the game.

The three-dimensional game of this invention may be played by two or more players. One of the players is selected by lot or otherwise to begin the game. The player draws a card from the deck which depicts the course over which the vehicle must be directed. A point value, depending upon the degree of difficulty involved, is assigned to each course. The player accumulates these points by successfully guiding the vehicle over the course.

The vehicle 13 is placed on the lower left first track member 15, as indicated on the card 19 that the player has drawn, and the motor 69 is energized through the switch 71. The self-propelled vehicle begins traversing the metal panel 47 of the first track member 15. By manipulating the knobs 29, the player must align the next track member, while the vehicle is moving, so that a substantially continuous path is provided over which the vehicle may pass from the first to the second track member. The player continues manipulating the knobs while the vehicle is moving, guiding the vehicle along the prescribed course through rotation of the track members. The magnetic attraction of the vehicle's wheels for the metal panels of the track members serves to maintain the vehicle on the track members, even when the track members are rotated such that the vehicle is upside down. If the player does not rotate the proper track member into the proper position before the vehicle reaches the edge of the track member over which it is crossing, the vehicle may fall from the track, may stop, or may go off course.

The point value indicated on the card is awarded for the successful completion of the course. The player accumulating the highest score wins the game. The game of the present invention thus involves both skill and chance; the outcome is not only dependent upon the players' skill in guiding the vehicle over the course, but also upon chance in the draw of the cards.

I claim:

1. A three-dimensional, player manipulatable game including:

a self-propelled vehicle having a plurality of wheels, a lattice-like support frame, a plurality of track members each rotationally supported on the lattice-like support frame and providing a vehicle supporting path located in a plane extending at right angles to the lattice-like support frame, the track members being located at the intersections of the lattice-like support frame and being rotatable between a plurality of predetermined positions with the track members being dimensioned so that in some of said predetermined positions the paths of a set of adjacent track members will form a continuous path upon which the vehicle may travel from one track member to another and in others of said predetermined positions the track members will provide a discontinuity in the path of travel of the vehicle, means manipulatable by the players for individually rotating the track members about their axes between said plurality of predetermined positions, means to detain the track members in the predetermined positions, and means on the vehicle and the track members for holding the vehicle on the track member independent of the rotational orientation of the track members.

2. The three-dimensional game of claim 1 wherein each track member comprises:

a rectangular panel having holes along the longitudinal edges of the panel;

two holders removably mounted on the longitudinal edges of the panel having holes corresponding to the holes of the panel, each holder including:

(a) a pin extending through the holes of the holder and the corresponding hole of the panel, to hold the panel fixed relative to the holder;

(b) a spindle extending through a corresponding hole in the support frame having a first cylindrical portion for rotation of the track member and a second portion connected to a knob to allow for rotation of the track member through manipulation of the knob; and (c) two shoulders extending over a portion of both surfaces of the panel having raised edges so that together the two holders define a pathway to maintain the vehicle's direction of travel in a direction substantially parallel to the longitudinal axis of the panel, the two shoulders being joined so as to form a channel, each shoulder having a set of projections for holding the panel rigidly within the channel between the projections.

3. The three-dimensional game of claim 1 wherein the means for holding the vehicle on the track members includes:

means for magnetizing a plurality of the wheels of the self-propelled vehicle; and a metallic pathway provided on each track member for attracting the magnetized wheel of the vehicle.

4. The three-dimensional game of claim 3 wherein the means for magnetizing a plurality of the wheels of the self-propelled vehicle includes:

a permanent magnet held within each wheel; and magnetizable rings encircling the permanent magnet, the rings being mounted on the surfaces of the wheels to contact the metallic pathway of each track member.

5. The three-dimensional game of claim 1 in which each track member has a pair of vehicle supporting tracks which tracks are located on opposite sides of the track member.

6. The three-dimensional game of claim 1 in which the predetermined positions of the adjacent track members which form a continuous path are those in which track members of diagonally located track members are aligned.

* * * * *